United States Patent [19]

Sommer

[11] 4,030,222

[45] June 21, 1977

[54] CARTRIDGE LOADING DEVICE FOR REVOLVERS

[76] Inventor: Carl G. Sommer, 81-27 250th St., Bellerose, N.Y. 11426

[22] Filed: May 24, 1976

[21] Appl. No.: 689,362

[52] U.S. Cl. ..... 42/89
[51] Int. Cl.[2] ..... F42B 39/04
[58] Field of Search ..... 42/89, 88, 87

[56] References Cited

UNITED STATES PATENTS

| | | | |
|---|---|---|---|
| 2,637,930 | 5/1953 | Mason | 42/89 |
| 3,667,146 | 6/1972 | Dupouy | 42/89 |

*Primary Examiner*—Charles T. Jordan
*Attorney, Agent, or Firm*—Robert D. Farkas

[57] ABSTRACT

This disclosure pertains to a circular plate having a plurality of cam arms depending downward therefrom. Each cam arm is adapted to grasp a cartridge and to align the cartridges so grasped over the openings in the cylinder of revolver. A rapidly applied force on the uppermost surface of the cylindrical plate causes the cartridges to engage the openings in the cylinder and to be released from the cam arms as the cam arms are forced in a downward and outward direction by a surface of the cam arms engaging the uppermost face of the cylinder.

7 Claims, 5 Drawing Figures

CARTRIDGE LOADING DEVICE FOR REVOLVERS

BACKGROUND OF THE INVENTION

1. The Field of the Invention

This invention relates to cartridge loading devices for revolvers and more particularly to that class utilizing a unidirectional force to satisfactorily eject the cartridges from the cartridge loading device into the cylinder of a revolver and into the openings in a cylinder of a revolver.

2. Description of the Prior Art

The prior art abounds with a variety of cartridge loading clips for revolvers. U.S. Pat. No. 1,891,437 issued on Dec. 20, 1932 to T. A. Milmore teaches a flexible strip to which is affixed a plurality of cartridge engaging clamps along the length thereof. The cartridges are inserted in the cartridge receiving openings in the cylinder and by exerting a tangential force on the flexible strips. The cartridges are allowed to disengage from the cartridge grasping clips as the cylinder rotates. U.S. Pat. No. 2,592,415 issued on Apr. 8, 1952 to A. J. Grogan discloses a similar technique for dispensing cartridges in unison within a rotating cylinder. U.S. Pat. No. 3,667,146 issued on June 6, 1972 to J. Dupouy teaches a flat support having a concave edge and shaped as a circular sector matching a portion of the cylinder, and cartridge case securing elements located in positions on the support, registering with the cylinder cartridge chambers and having the elements opening out on the same side as the concave edge of the support. Thus, a portion of the cylinder cartridge chambers are filled with cartridges utilizing, successively, a thrusting motion followed by a sideway motion. All of the above patents suffer the common deficiency of requiring the cartridges that are to be inserted within the chambers to be aligned thereto and that only some of the chambers be loaded at a time.

SUMMARY OF THE INVENTION

A primary object of the present invention is to provide a cartridge loading device which utilizes a single thrusting motion to entirely load all the chambers within the cylinder.

Another object of the present invention is to provide a cartridge aligning device which automatically positions the cartridges in the required circle of insertion corresponding with the cartridge accepting chambers.

Still another object of the present invention is to provide a cartridge loading device which may be utilized repeatedly if desired or of such economical design permitting its disposable use.

A further object is to provide a cartridge loading device which may be stored in a planar condition when not being utilized to load cartridges into the chambers of a cylinder.

The need has existed for an apparatus which enables a full complement, if desired, of cartridges to be inserted into cartridge receiving chambers, requiring only the use of a thrusting force to disengage the prepositioned and properly located cartridges from the loading device. The present invention fully satisfies these requirements by utilizing a plurality of cartridge grasping cams, each hingeably affixed to a circular plate. The longitudinal axes of each cartridge extend normally to the surface of the circular plate and are disposed in circular relationship matching the central longitudinal axis displacements of each of the cylinder chambers. Each of the cams have a pair of edges riding on the outermost edge of the cylinder. These edges are arranged so that the displacement of the circular plate towards the cylinders causes the cams to hingeably pivot outwardly, disengaging the cartridges therefrom, and permitting the cartridges to fully and freely enter the chambers.

These objects, as well as other objects of the present invention will become more readily apparent after reading the following description of the accompanying drawings.

DESCRIPTION OF THE PREFERRED EMBODIMENT

The structure and method of fabrication of the presentinvention is applicable to a circular disc whose outermost diameter is slightly less than the outside diameter of the cylinder of the revolver. A plurality of downwardly extending cartridge grasping cams are hingeably affixed equidistantly along the marginal edge of the cylindrical plate. Each cam is permitted to grasp a cartridge wth the projectile end furthestmost from the plate. Each cam gradually tapers inwardly from its furthermost point from the plate to an edge which runs normal to the surface of the plate. The cartridge and the cam separate through a cutout portion in the cam adjacent the aforementioned edge. The cams may be provided with an overall length less than the length of each cartridge and projectile assembly. Thus, the cartridges are aligned in circular relationship corresponding with the chambers in the cylinder and upon insertion of the projectiles into the chambers, a point will be reached, as the plate is forced towards the cylinder, where the cam engages the marginal edge of the cylinder. As the cam is further forced towards the cylinder, the marginal edge of the cylinder and the shape of the cam edges engaging the marginal edge of the cylinder causes the cams to hinge outwardly and ultimately disengage the partially captured cartridge from therewithin. At this point in the loading process, all the cartridges freely and totally enter the chambers requiring little or no assistance by continuing the ongoing application of force urging the cylindrical plate towards the surface of the cylinder.

Figure 1:
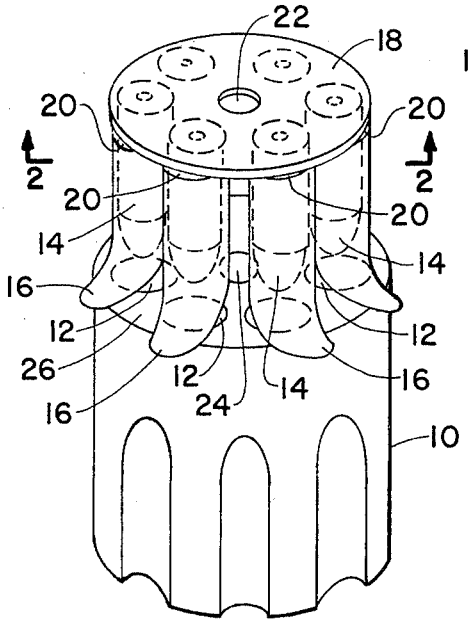
FIG. 1 is a perspective view of the instant invention and the cylinder portion of a revolver.

Now referring to the FIGURES, and more particularly to the embodiment illustrated in FIG. 1 showing the cylinder 10 of a revolver. Chambers 12 are adapted to receive cartridges 14, shown in dotted lines. The cartridges are retained within cams 16, each of which are hingeably affixed to circular plate 18 at hinge members 20. Hole 22 is provided to permit projection 24 to enter therethrough when plate 18 is in contact with cylinder surface 26.

Figure 2:
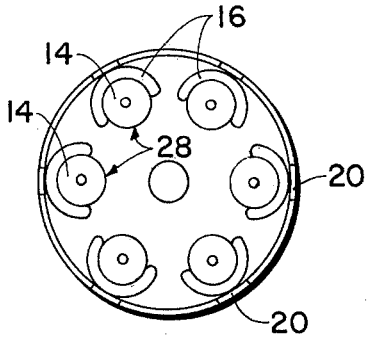
FIG. 2 is a plan view taken along line 2—2 viewed in the direction of arrows 2—2 as shown in FIG. 1 showing a plurality of bullets or cartridges retained therein.

FIG. 2 illustrates cartridges 14 included within cams 16 having an open portion 28 enabling the cams to be pivoted outwardly from hinge member 20.

Figure 3:
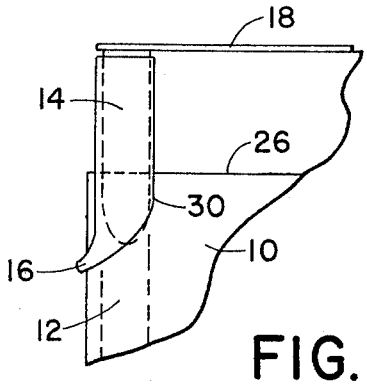
FIG. 3 is a side elevation view of the embodiment illustrated in FIG. 1 at the initial cartridge alignment stage.

FIG. 3 illustrates a portion of the cylinder 10 having a chamber 12 therein. Cartridge 14 is shown partially inserted within the chamber to an extent determined by the spacing between plate 18 and surface 26. Cam 16 has a portion of its exterior surface engaging surface 26 at a point 30 on the peripheral edges of surface 26 whilst still successfully capturing cartridge 14 within the cartridge grasping portion of cam 16.

Figure 4:
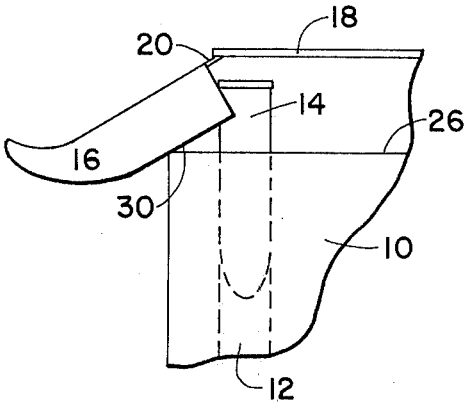
FIG. 4 is a side elevation view of the embodiment illustrated in FIG. 1 at the intermediate cartridge insertion stage.

FIG. 4 illustrates circular plate 18 disposed in closer relationship to surface 26 than shown in FIG. 3. Cam 16 is deflected outwardly by touching surface 26 at point 30 thereon. Hinge 20 permits cam 16 to assume the angular position shown whilst the opening 28, shown in FIG. 2, enables cartridge 14 to become disengaged from cam 16.

Figure 5:
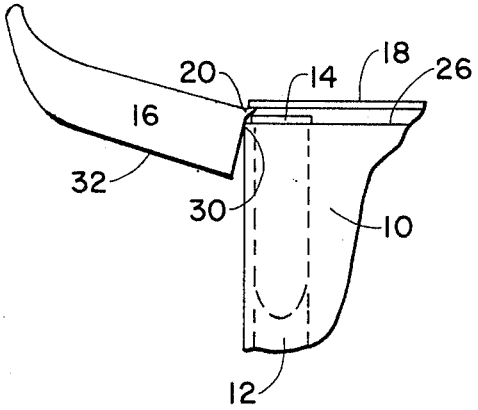
FIG. 5 is a side elevation view of the embodiment illustrated in FIG. 1 at the completed cartridge insertion stage.

FIG. 5 shows circular plate 18 virtually in touching engagement with cylinder surface 26. The cartridge 14 is fully seated within chamber 12 and is totally free from cam 16. Edge 32 of cam 16 has a ramped surface enabling the cam to move outwardly from cylinder 10. In the position shown, circular plate 18 and the cams hingeably affixed thereto may be discarded, after removal, or reused, if so desired.

One of the advantages of the present invention is a cartridge loading device which utilizes a single thrusting motion to entirely load all the chambers within the cylinder.

Another advantage of the present invention is a cartridge aligning device which automatically positions the cartridges in the required circle of insertion corresponding with the cartridge accepting chambers.

Still another advantage of the present invention is a cartridge loading device which may be utilized repeatedly if desired or of such economical design permitting its disposable use.

A further advantage of the present invention is a cartridge loading device which may be stored in a planar condition when not being utilized to load cartridges into the chambers of a cylinder.

Thus there is disclosed in the above description and in the drawings, an embodiment of the invention which fully and effectively accomplishes the objects thereof, However, it will become apparent to those skilled in the art, how to make variations and modifications to the instant invention. Therefore, this invention is to be limited not by the specific disclosure herein, but only by the appending claims.

I claim:

1. A cartridge loading device for revolvers comprising a plate, a plurality of cartridge grasping cams, hinging means for independently hingeably affixing each of said plurality of said cartridge grasping cams to said plate, a portion of said each of said plurality of said cartridge grasping cams broken away permitting a cartridge to be removed from said cartridge grasping cam grasping said cartridge and for insertion into a chamber in the cartridge loading surface of a cylinder of a revolver, said plurality of said cartridge grasping cams disposed circularly about said plate, said plurality of said cartridge grasping cams each having a cylinder contacting surface, said cylinder contacting surface for disposing said each of said plurality of said cartridge grasping cams radially outwardly from said cartridge loading surface upon said plate being manually urged towards said cartridge loading surface, said cylinder contacting surface for engagement with the marginal edges of said cartridge loading surface, said cylinder contacting surface forming an acute angle with the longitudinal axis of said cartridge when said cartridge is grasped within said cartridge grasping cam.

2. The cartridge loading device for revolvers as claimed in claim 1 wherein said plate comprises circular marginal edges.

3. The cartridge loading device for revolvers as claimed in claim 2 wherein said hinging means comprises a flexible hinging element fixedly secured to said each of said plurality of said cartridge grasping cams and to said circular marginal edges of said plate.

4. The cartridge loading device for revolvers as claimed in claim 1 wherein said plurality of said cartridge grasping cams and said hinging means and said plate comprise a unitary construction.

5. The cartridge loading device for revolvers as claimed in claim 3 wherein said hinging means is disposed radially outwardly from said portion of said each of said plurality of said cartridge graspings cams.

6. The cartridge loading device for revolvers as claimed in claim 1, wherein said longitudinal axis of said cartridge is disposed normally to a lateral surface of said plate.

7. The cartridge loading device for revolvers as claimed in claim 2, wherein said cylinder contacting surface extends a lesser distance from said circular marginal edges of said plate than the length of said cartridge and the projectile fitted thereto.

* * * * *